US005514835A

United States Patent [19]

Wing

[11] Patent Number: 5,514,835

[45] Date of Patent: May 7, 1996

[54] HEATING COIL ELEMENT REPAIR MEMBER

[76] Inventor: David A. Wing, 17 Vivian St., Auburn, Me. 04210

[21] Appl. No.: 278,500

[22] Filed: Jul. 21, 1994

[51] Int. Cl.[6] ..... H01R 4/20

[52] U.S. Cl. ..... 174/84 C; 174/94 R; 439/877; 439/887

[58] Field of Search ..... 174/84 C, 84 R, 174/94 R; 439/877, 887

[56] References Cited

U.S. PATENT DOCUMENTS

| | | | |
|---|---|---|---|
| 2,173,668 | 9/1939 | Smith | 174/84 C |
| 3,036,147 | 5/1962 | Wheaton et al. | 174/84 C |
| 3,165,575 | 1/1965 | Lynch, Jr. et al. | 174/84 C |
| 3,320,356 | 5/1967 | Kirwin | 174/94 R |
| 4,829,146 | 5/1989 | Duve | 174/94 R |
| 4,959,508 | 9/1990 | McGrane | 174/84 |

*Primary Examiner*—Morris H. Nimmo
*Attorney, Agent, or Firm*—William Nitkin

[57] ABSTRACT

A cylindrical heating coil element repair member for joining the two ends of a broken electric heating coil element wire wherein the broken wire ends are inserted, respectively, into apertures formed in each end of the cylindrical repair member until they make contact with the solid central portion of the repair member and where the end portions with wire ends therein are crimped onto each wire end to retain them therein to provide electrical continuity through the repaired wire.

2 Claims, 1 Drawing Sheet

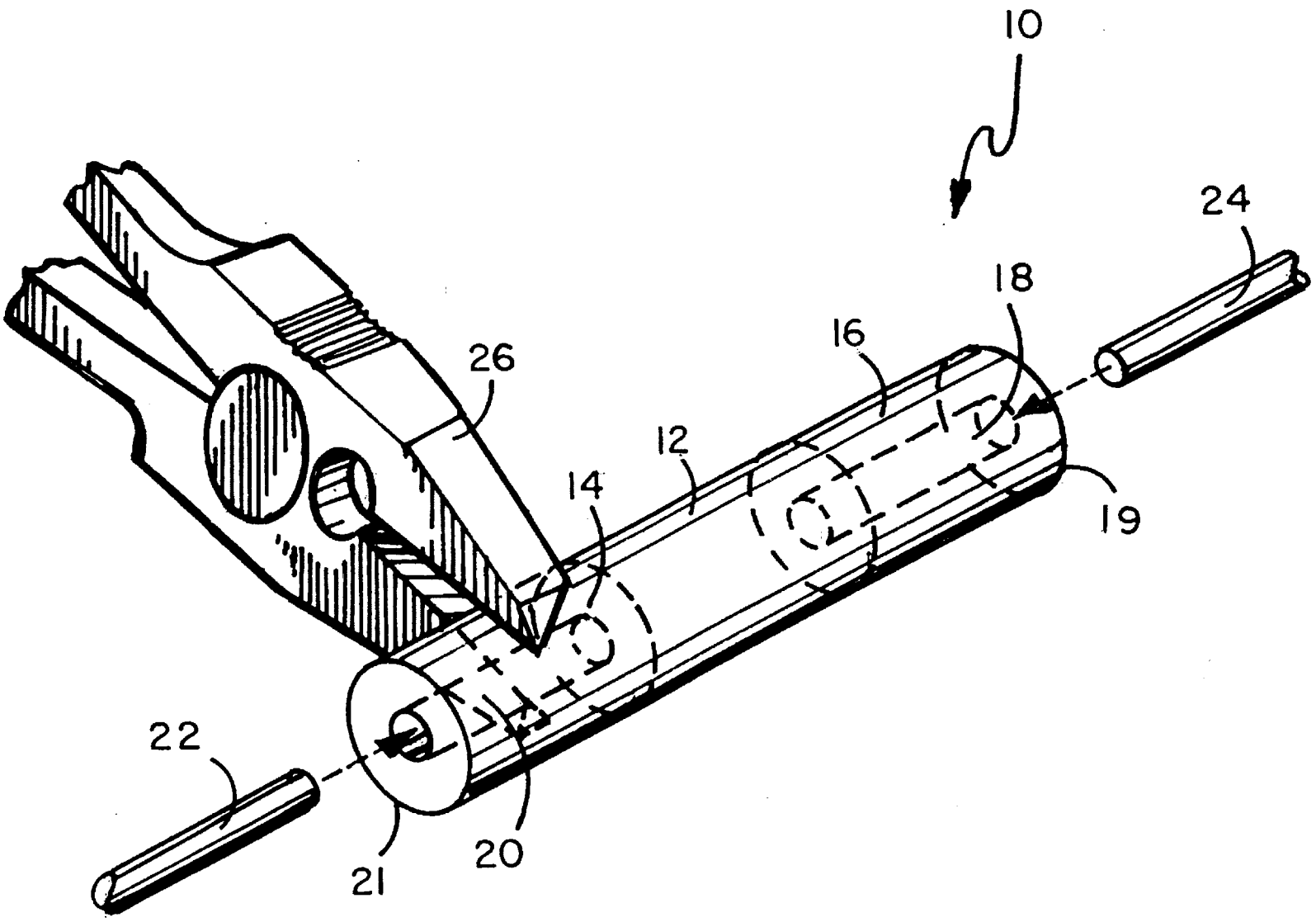
10
24
18
19
16
12
14
26
20
21
22

HEATING COIL ELEMENT REPAIR MEMBER

BACKGROUND OF THE INVENTION

1. Field of the Invention

The device of this invention resides in the area of heating coil repair members and more particularly relates to a repair member used to interconnect broken ends of a wire heating coil element.

2. Description of the Prior Art

Structures to join wires exist in the prior art which structures generally consist of tubular repair elements into which wires to be connected are inserted and which tubular repair elements are then crimped near their ends to securely retain the wires therein. An example of such a device is seen in U.S. Pat. No. 2,173,668 to D. F. Smith for an Electric Wire Connecting Device.

While such tubular repair elements requiring wire crimping are known, such tubular repair elements have not been used to repair heating coil elements which reach very high heat levels in operation because, for one reason, such prior art tubular repair elements have not been made of a material that is sufficiently resistant to such high heat. Such prior art tubular repair elements would distort and fail if used to interconnect broken ends of a wire heating coil. It has been appreciated in the past that tubular repair elements can be made of the same material as the wire ends to be joined. Heating coil elements, though, are made of extremely hard, brittle materials such as tungsten and if one were to build prior art tubular repair elements of tungsten or metal of equivalent hardness, they would be too difficult to crimp around the broken ends of the wire.

SUMMARY OF THE INVENTION

It is an object of this invention to provide a wire repair member which has the ability to withstand great heat for use in the repair of a broken wire of an electric heating coil such as found, for example, in electric clothes dryers and the like. The repair member of this invention has a cylindrical body with a solid central portion and two end portions, each having an elongated, centrally disposed, circular aperture formed along its axis for receipt of the ends of the broken wire member. The repair member of this invention can be made of tungsten or of the same material as the wires to be joined. After the ends of the broken wire have been fully inserted within the two apertures in the repair member of this invention, pliers or other crimping means can then be used to crimp the end portions of the repair member such that they are crimped inward against the wires inserted into the elongated apertures to provide electrical continuity through said repaired wire.

It is therefore a further object of this invention to provide a heating coil element repair member made of tungsten or equivalent hard metal which when the ends of the heating coil wire are positioned therein not only will not be damaged by high heat, but also will provide similar resistance to electric current as the resistance of the heating coil wire itself and which heating coil element repair member can be successfully crimped. Although tungsten is an extremely hard metal and very difficult to work with and crimp, the design of the heating element repair member of this invention allows it to be successfully crimped.

BRIEF DESCRIPTION OF THE DRAWINGS

The FIGURE illustrates the repair member of this invention showing the ends of a broken wire about to be inserted within the two apertures in the end portions of the repair member and pliers about to crimp the end portions of the repair member to retain the wire ends therein.

DESCRIPTION OF THE PREFERRED EMBODIMENT(S)

In a preferred embodiment the wire heating coil element repair member 10 of this invention, as seen in the FIGURE, is approximately 0.75 inch in length. Cylindrical body 10 has a central body portion 12 approximately 0.25 inch in length made of solid metal and has first and second ends 19 and 21. Disposed respectively at first and second ends 19 and 21 are first and second end portions 16 and 14, each being approximately 0.25 inch in length in a preferred embodiment. Centrally defined in first and second end portions 16 and 14, respectively, of cylindrical body 10 extending axially therein are first and second apertures 18 and 20, each being approximately 0.064 inch in diameter and extending inward approximately 0.25 inch from first and second ends 19 and 21, leaving central body portion 12 solid. To use the device of this invention, second wire end 22 of the broken heating coil element is inserted into second aperture 20 until it makes contact with solid central body portion 12. In the same manner first wire end 24 is inserted into first aperture 18 until it makes contact with solid central body portion 12. The diameter of repair member 10 in a preferred embodiment is approximately 0.100 inch, and the thickness of the walls around first aperture 18 and second aperture 20 is approximately 0.018 inch. These dimensions are critical for the successful utilization of the device of this invention because they allow the tungsten end portions or end portions made of equivalent metal of the repair member to be crimped. After first and second wire ends 24 and 22 have been inserted, respectively, within first and second apertures 18 and 20, the end portions are then crimped by closing a crimper, such as a pair of pliers 26, around each end portion, and squeezing the metal of the repair member together, securing first and second wire ends 24 and 22, respectively, within first and second apertures 18 and 20.

Great savings can be obtained by using the repair member of this invention to repair broken heating coil elements since such broken heating coil elements have usually been disposed of and replaced with new elements. The heating element repair member of this invention now allows for such heating coils to be successfully repaired where they could not be in the past using prior art tubular repair members.

Although the present invention has been described with reference to particular embodiments, it will be apparent to those skilled in the art that variations and modifications can be substituted therefor without departing from the principles and spirit of the invention.

I claim:

1. A repair member for repairing a heating coil element wire having a break defined therein forming a first end and a second end of said heating coil element wire, said first end disposed on one side of said break and said second end disposed on the other side of said break, said heating coil element wire made of a selected metal, said heating coil element wire having a diameter, comprising:

a cylindrical member having a diameter and first and second member ends, said cylindrical member made of the same selected metal as said heating coil element wire, said cylindrical member having a solid central body portion, a first end portion and a second end portion, said first end portion and said second end portion disposed, respectively, at said first and second member ends of said cylindrical member, said first and second member ends of said cylindrical member having, respectively, a first aperture and a second aperture defined axially therein forming walls around said first and second apertures, said walls having a thickness, said first and second apertures each having approximately the same diameter as the diameter of said heating coil element wire for receipt therein, respectively, of one of said first and second ends of said heating coil element wire, said first and second end portions with said first and second ends of said heating coil element wire disposed therein to be crimped to retain said first and second ends of said heating coil element wire, respectively, in said first and second end portions of said cylindrical member to provide electrical continuity through said heating coil element wire; and wherein said cylindrical member is approximately 0.75 inch in length and has a diameter of 0.100 inch, said first and second end portions of said cylindrical member are each approximately 0.25 inch in length, said central body portion is approximately 0.25 inch in length, said diameter of each of said first and second apertures is approximately 0.064 inch, and said walls around said first and second apertures each have a thickness of 0.018 inch.

2. The device of claim 1 wherein said repair member is made of tungsten.

* * * * *